US006578204B2

(12) United States Patent
Ozenkoski

(10) Patent No.: US 6,578,204 B2
(45) Date of Patent: Jun. 17, 2003

(54) TRANSFORMABLE THROW AND JACKET

(76) Inventor: Jason Ozenkoski, 1349 Dingledine Rd., St. Charles, MO (US) 63304

( * ) Notice: Subject to any disclaimer, the term of this patent is extended or adjusted under 35 U.S.C. 154(b) by 0 days.

(21) Appl. No.: 09/972,421

(22) Filed: Oct. 5, 2001

(65) Prior Publication Data

US 2002/0042939 A1 Apr. 18, 2002

Related U.S. Application Data

(60) Provisional application No. 60/238,274, filed on Oct. 5, 2000.

(51) Int. Cl.[7] ..... A41D 3/02
(52) U.S. Cl. ..... 2/86; 2/69
(58) Field of Search ..... 2/86, 88, 94, 85, 2/87, 89, 93, 49.1, 52; 5/419, 420

(56) References Cited

U.S. PATENT DOCUMENTS

| | | | | |
|---|---|---|---|---|
| 1,496,283 A | * | 6/1924 | Wright | |
| 1,509,296 A | | 9/1924 | Hopewell | |
| 1,610,799 A | * | 12/1926 | Lack et al. | |
| 1,641,039 A | * | 8/1927 | Beaud | |
| 1,736,594 A | * | 11/1929 | Hart | |
| 1,916,068 A | * | 6/1933 | Nyhagen | |
| 2,024,044 A | * | 12/1935 | Johnson | 2/88 |
| 2,656,540 A | | 10/1953 | Stephenson | |
| 3,590,864 A | * | 7/1971 | Vechesloff | 135/5 R |
| 3,693,190 A | * | 9/1972 | Hickling | 2/69.5 |
| 4,142,264 A | | 3/1979 | Whiting | |
| 4,240,159 A | | 12/1980 | Wrightson | |
| 4,484,362 A | * | 11/1984 | Asher | 2/69 |
| 5,210,891 A | * | 5/1993 | Avital et al. | 5/420 |
| 5,697,102 A | | 12/1997 | Benjamin | |
| 5,875,492 A | | 3/1999 | Moss | |
| 5,924,132 A | * | 7/1999 | Wigutow | 2/69 |
| 5,946,723 A | | 9/1999 | DiPrato et al. | |
| 6,014,772 A | * | 1/2000 | Connelly | 2/69 |
| 6,073,283 A | * | 6/2000 | Zheng | 5/417 |

OTHER PUBLICATIONS

Pacific Poncho (www.qspeed.com/poncho/) Jul. 12, 2001.

* cited by examiner

*Primary Examiner*—John J. Calvert
*Assistant Examiner*—Alissa L Hoey
(74) *Attorney, Agent, or Firm*—Polster, Lieder, Woodruff & Lucchesi

(57) ABSTRACT

A substantially fortified transformable blanket and jacket assembly composed of a secured union between mating and separating connection points, incorporated bundling assemblies and transport assembly for application to a pliable sheet.

16 Claims, 2 Drawing Sheets

TRANSFORMABLE THROW AND JACKET

CROSS-REFERENCE TO RELATED APPLICATIONS

This application claims the priority of U.S. Provisional Patent Application No. 60/238,274, filed Sep. 5, 2000, the contents of which are expressly incorporated herein by reference.

STATEMENT REGARDING FEDERALLY SPONSORED RESEARCH OR DEVELOPMENT

Not Applicable

BACKGROUND OF THE INVENTION

Convertible blanket jackets have heretofore been disclosed. For example, U.S. Pat. No. 5,875,492 issued to Moss discloses a water resistant, double layered blanket that can be converted into a coat with a removable hood used for storing the garment when not in use. This configuration is relatively expensive to manufacture, and does not breathe well due to its inherent impermeability to water. Additionally, this configuration is less aesthetically pleasing due the fact the there is no collar portion provided.

Therefore, there is a need in the art for a transformable throw and jacket that is durable, able to allow perspiration to escape from the user, and relatively inexpensive to manufacture.

BRIEF SUMMARY OF THE INVENTION

Among the several objects of the present invention is the provision of a transformable throw and jacket assembly, bundling assembly, and transport assembly incorporated into a unitary garment constructed from a pliable material.

Another object of the present invention is the provision of a transformable throw and jacket assembly constructed from a substantially durable pliable material.

Another object of the present invention is the provision of a transformable throw and jacket assembly with a substantially durable pliable transport assembly thereto.

Another object of the present invention is the provision of a transformable throw and jacket assembly with a substantially durable pliable material for securing a substantially durable pliable strap to a side of said substantially durable pliable material.

Another object of the present invention is the provision of a transformable throw and jacket assembly that is easy to store.

Another object of the present invention is the provision of a transformable throw and jacket assembly that is inexpensive to manufacture.

Another object of the present invention is the provision of a transformable throw and jacket assembly with a gauge for reference as folding points when folding the pliable sheet.

Other objects and features will be in part apparent and in part pointed out hereinafter.

In accordance with the objects of the invention there is provided a transformable blanket jacket comprising a piece of material having upper, right and left edges thereof, a first fastener attached to the material parallel the left edge of the material, a second fastener attached to the material parallel with the upper edge and offset from the upper edge of the material, a third fastener attached to the material parallel the right edge of the material, and a fourth fastener attached to the material parallel with the upper edge and offset from the upper edge of the material wherein the first fastener is adapted to fasten to the second fastener and the third fastener is adapted to fasten to the fourth fastener to form right and left sleeves, respectively, and the material between the upper edge and the second and fourth fasteners can be folded to form a collar.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
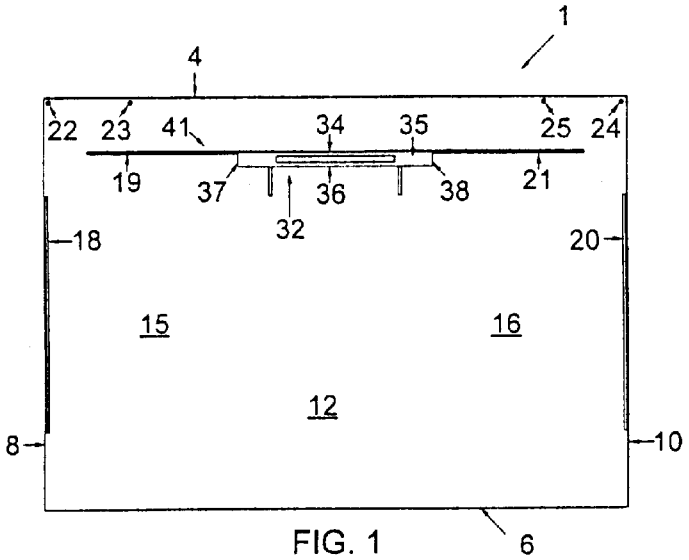
FIG. 1 is a top plan view of a transformable blanket jacket of the present invention in its extended blanket position.

Referring now to the drawings, FIG. 1 shows an embodiment of a transformable blanket jacket in its extended blanket position generally at reference numeral 1. The transformable blanket jacket 1 forms a generally rectangular, planar surface in its extended position, with an upper or top side 4, a lower or bottom side 6, a left side 8 and a right side 10. A front surface 12 is visible in FIG. 1. It is to be understood that this configuration contemplates the transformable blanket jacket extended upon a flat surface, since the materials used in the construction of the transformable blanket jacket are pliable.

The transformable blanket jacket of the present invention may be viewed as having two halves formed by an imaginary line generally equidistant from the left side 8 and the right side 10, and bisecting the upper side 4 and lower side 6 as a midline. Such an imaginary line forms a left half 15 and a right half 16.

Located on the front surface 12, near the left side 8 is a first, cooperating fastener 18. Located on the front surface 12, toward but spaced from the upper side 4 and on the left half 15 is a second, cooperating fastener 19, generally transverse to the first, cooperating fastener 18. Also located on the front surface 12, near the right side 10 is a third, cooperating fastener 20. Similarly, toward but spaced from the upper side 4 is a fourth, cooperating fastener 21 on the right half 16, and generally transverse to the third, cooperating fastener 20. In the preferred embodiment of the present invention, first, cooperating fastener 18, second, cooperating fastener 19, third cooperating fastener 20 and fourth, cooperating fastener 21 are mating zippers, although it will be understood by those skilled in the art that other fasteners could be employed, such as: hooks and loops, sold under the trademark VELCRO; buttons and button holes, and the like.

Located on front surface 12, spaced a predetermined distance from upper side 4, amid left side 8 and right side 10 is a durable, pliable neck reinforcement component 32 having a surface 35, an upper or top side 34, a lower or bottom side 36, a left side 37 and a right side 38. Neck reinforcement part 32 is preferably constructed from a durable, pliable material such as canvas. In the preferred embodiment of the present invention, upper side 34 of neck reinforcement part 32 is generally coextensive with second, cooperating fastener 19 and fourth cooperating fastener 21, coexistence component 41.

Located on the front surface 12, near the left side 8 and upper side 4 is a fifth, cooperating fastener 22. Also located on the front surface 12, near top side 4, toward but spaced a predetermined distance from the left side 8, is a sixth, cooperating fastener 23. Similarly, located on the front surface 12, near the right side 10 and upper side 4 is a seventh, cooperating fastener 24. Also located on the front surface 12, right half 16 near top side 4, toward but spaced a predetermined distance from the right side 10, is an eighth, cooperating fastener 25. In the preferred embodiment of the present invention, fifth, cooperating fastener 22, sixth cooperating fastener 23, seventh cooperating fastener 24 and eighth, cooperating fastener 25 are mating snaps, although it will be understood by those skilled in the art that other fasteners could be employed, such as: hooks and loops, sold under the trademark VELCRO; buttons and button holes, and the like.

Figure 2:
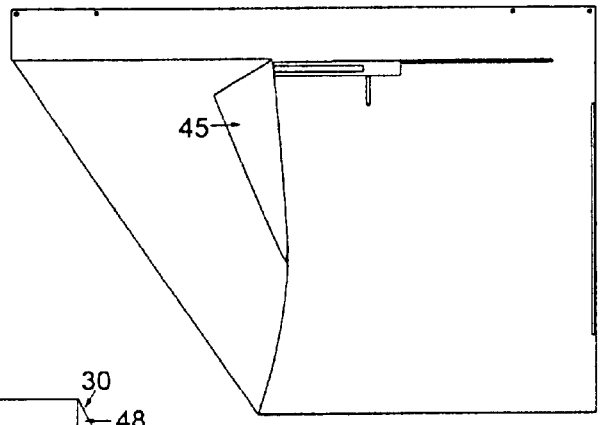
FIG. 2 is a top plan view illustrating the formation of the right sleeve and right lapel.
Figure 3:
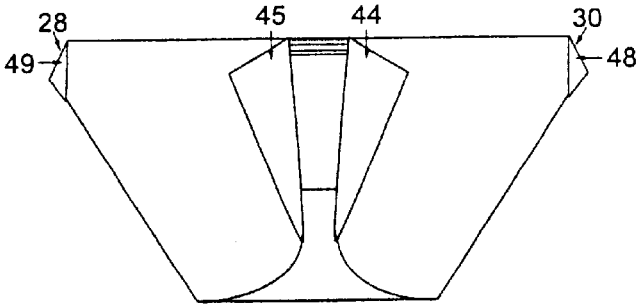
FIG. 3 is a top plan view of a transformable throw jacket in its folded fastened jacket arrangement illustrating the formation of sleeves, lapels and cuffs.
Figure 4:
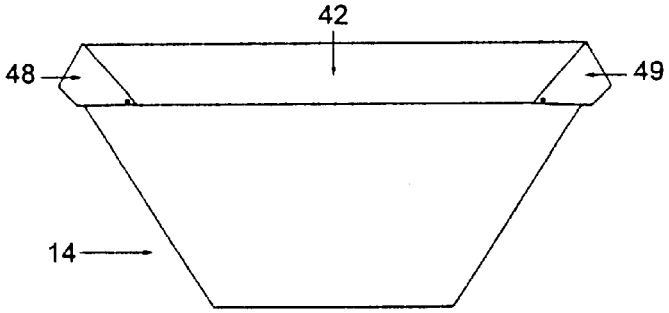
FIG. 4 is a rear elevation view of a transformable throw jacket in its folded fastened jacket arrangement illustrating the formation of the collar and the cuffs secured in the fastened position.

In use as a jacket, first cooperating fastener 18 is brought into operable engagement with second, cooperating fastener 19, forming a first, right sleeve opening 28 and a right lapel 45 as illustrated in FIG. 2. In like manner, third, cooperating fastener 20 is brought into operable engagement with fourth, cooperating fastener 21 to form a second, left sleeve opening 30 and a left lapel 44 as illustrated in FIG. 3. With coexistence component 41 used as a reference point, upper side 4 is folded to form a collar 42 as illustrated in FIG. 4. Next, fifth cooperating fastener 22 is brought into engagement with sixth, cooperating fastener 23, forming a first, right sleeve cuff 49. In like manner, seventh, cooperating fastener 24 is brought into operable engagement with eighth, cooperating fastener 25 to form a second, left sleeve cuff 48. FIG. 4 shows an embodiment of a transformable blanket jacket back surface in its folded, fastened jacket arrangement generally at reference numeral 14.

Figure 5:
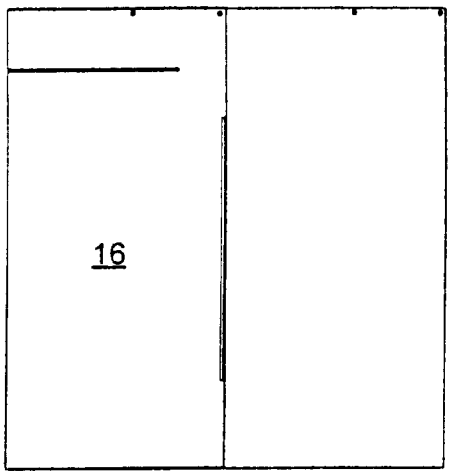
FIG. 5 is a rear elevation view illustrating the folded right side 15 utilizing right side 38 of neck reinforcement component 32 as a reference point folding gauge for bundling transformable throw jacket into transport carrying formation.
Figure 6:
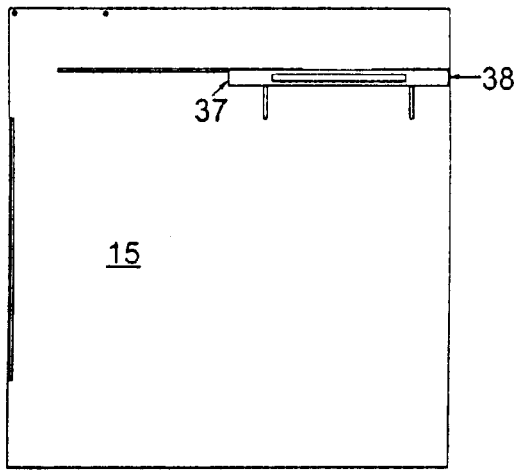
FIG. 6 is a top plan view of FIG. 5 illustrating the folded right side 16 utilizing right side 38 of neck reinforcement component 32 as a reference point folding gauge for bundling transformable throw jacket into transport carrying formation.
Figure 7:
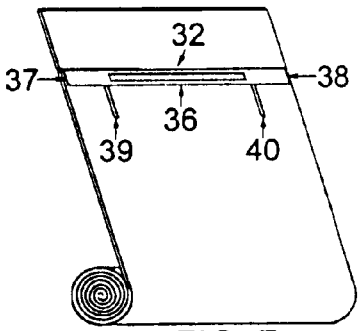
FIG. 7 is a perspective view illustrating the bundling and transport assembly of a transformable throw jacket folded and partially rolled for transport carrying formation.
Figure 8:
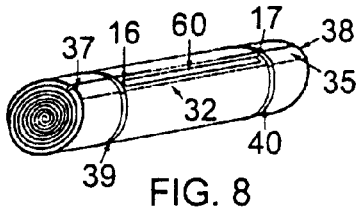
FIG. 8 is a perspective view of a transformable blanket jacket of the present invention with transport assemblies engaged in the carrying formation.

Referring now to FIGS. 5–7, the blanket jacket may be disassembled and bundled in transport carrying formation, where the right side 38 of neck reinforcement component 32, constructed with a predetermined overall length functions as a reference point gauge when folding the right half 16 as illustrated in FIGS. 5, 6, and 7. In like manner, left side 37, of neck reinforcement component 32 functions as a reference point gauge when folding left half 15 for bundling the transformable blanket jacket 1 into transport carrying formation. Referring to FIG. 7 secured to bottom side 36 toward but spaced from left edge 37 of neck reinforcement part 32 is a first left bundling loop 39. Similarly, secured to bottom side 36 toward but spaced from right edge 38 of neck reinforcement part 32 is a second right bundling loop 40. Referring to FIG. 8, attached to the pliable neck reinforcement component 32 is a carry strap 60.

What has been described is a one-piece transformable blanket jacket constructed from a substantially durable, pliable material, reinforced securement sections, bundling assembly, and transport assembly incorporated into one unitary garment constructed from a pliable material.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A transformable blanket jacket comprising:

a piece of material having upper, right and left edges;

a first fastener attached to the material parallel the left edge of the material;

a second fastener attached to the material parallel with the upper edge and offset from the upper edge of the material;

a third fastener attached to the material parallel the right edge of the material;

a fourth fastener attached to the material parallel with the upper edge and offset from the upper edge of the material;

wherein the first fastener is adapted to fasten to the second fastener and the third fastener is adapted to fasten to the fourth fastener to form right and left sleeves, respectively, and the material between the upper edge and the second and fourth fasteners can be folded to form a collar;

a fifth fastener attached to the material near the intersection of the left and upper edges;

a sixth fastener attached to the material at a point spaced apart from the fifth fastener;

a seventh fastener attached to the material near the intersection of the right and upper edges;

an eighth fastener attached to the material at a point spaced from the sixth fastener; and wherein the fifth fastener is attached to the sixth fastener and the seventh fastener is attached to the eighth fastener to form cuffs of the blanket jacket.

2. The blanket jacket of claim 1 wherein the material further defines a bottom edge and wherein ends of the first and third fasteners do not extend to the bottom edge, such that when the first and second fasteners are attached and the third and fourth fasteners are attached, the material at the intersection of the bottom and left edges and at the intersection of the bottom and right edges form left and right lapels of the blanket jacket, respectively.

3. The blanket jacket of claim 1 further comprising a pliable neck reinforcement component.

4. The blanket jacket of claim 3 further comprising a carry strap attached to the pliable neck reinforcement component.

5. The blanket jacket of claim 4 further comprising a bundling loop adapted to maintain the jacket in a cylindrical formation when the fasteners have been unfastened.

6. The blanket jacket of claim 4 further comprising a pair of bundling loops adapted to maintain the jacket in a cylindrical formation when the fasteners have been unfastened.

7. The blanket jacket of claim 1 wherein the material is water-resistant.

8. The blanket jacket of claim 1 wherein the material is fleece.

9. A transformable blanket jacket comprising:

a generally rectangular, pliable fabric, the generally rectangular fabric defining a front face and a back face, the front face further defining an upper edge, a lower edge, a left edge and a right edge, and a left half and a right half;

a first, cooperating fastener attached to the front face on the right half;

a second, cooperating fastener attached to the front face spaced from the upper edge and generally transverse to the first, cooperating fastener on the right half, the first, cooperating fastener adapted to mate with the second, cooperating fastener to define a right sleeve opening;

a third, cooperating fastener attached to the front face on the left half;

a fourth, cooperating fastener attached to the front face spaced from the upper edge and generally transverse to the third, cooperating fastener on the left half, the third, cooperating fastener adapted to mate with the fourth, cooperating fastener to define a right sleeve opening; and a neck reinforcement part defining a collar portion.

10. The blanket jacket of claim 9 further comprising at least one loop member attached to the neck reinforcement part for storage of the transformable blanket jacket.

11. The blanket jacket of claim 9 wherein the fabric is water-resistant.

12. The blanket jacket of claim 9 wherein the fabric is fleece.

13. The blanket jacket of claim 9 further comprising:

a fifth fastener attached to the fabric near the intersection of the left and upper edges;

a sixth fastener attached to the fabric at a point spaced apart from the fifth fastener;

a seventh fastener attached to the fabric near the intersection of the right and upper edges;

an eighth fastener attached to the fabric at a point spaced from the sixth fastener; and wherein the fifth fastener is attached to the sixth fastener and the seventh fastener is attached to the eighth fastener to form cuffs of the blanket jacket, respectively.

14. The blanket jacket of claim 9 wherein ends of the first and third fasteners do not extend to the lower edge, such that when the first and second fasteners are attached and the third and fourth fasteners are attached, the fabric at the intersection of the lower and left edges and at the intersection of the bottom and right edges form left and right lapels of the blanket jacket, respectively.

15. The blanket jacket of claim 9 further comprising a bundling loop adapted to maintain the jacket in a cylindrical formation when the fasteners have been unfastened.

16. The blanket jacket of claim 9 further comprising a pair of bundling loops adapted to maintain the jacket in a cylindrical formation when the fasteners have been unfastened.

* * * * *